US006352339B1

(12) United States Patent
Loyd et al.

(10) Patent No.: US 6,352,339 B1
(45) Date of Patent: Mar. 5, 2002

(54) VACUUM SYSTEM FOR CONTINUOUS INK JET PRINTERS

(75) Inventors: John C. Loyd, Centerville; James D. McCann, Waynesville; Richard T. Enz, Dayton; David A. Huliba, Centerville; James A. Katerberg, Kettering, all of OH (US)

(73) Assignee: Scitex Digital Printing, Inc., Dayton, OH (US)

( * ) Notice: Subject to any disclaimer, the term of this patent is extended or adjusted under 35 U.S.C. 154(b) by 0 days.

(21) Appl. No.: 09/211,777

(22) Filed: Dec. 14, 1998

(51) Int. Cl.[7] ..... B41J 2/045
(52) U.S. Cl. ..... 347/85
(58) Field of Search ..... 347/17, 7, 75, 347/85

(56) References Cited

U.S. PATENT DOCUMENTS 4,283,730 A * 8/1981 Graf ..... 347/75
4,591,870 A * 5/1986 Braun et al. ..... 347/75
5,394,177 A * 2/1995 McCann et al. ..... 347/7
5,821,963 A * 2/1995 Sutera et al. ..... 347/68

* cited by examiner

*Primary Examiner*—Huan Tran
(74) *Attorney, Agent, or Firm*—Barbara Joan Haushalter

(57) ABSTRACT

A system and method are provided for protecting the vacuum pump of an ink jet printer system from the harmful effects of condensation in the vacuum lines, and from the harmful effects of moisture and water in the vacuum lines. This is accomplished by suppressing the condensation and drying the vacuum line walls.

11 Claims, 1 Drawing Sheet

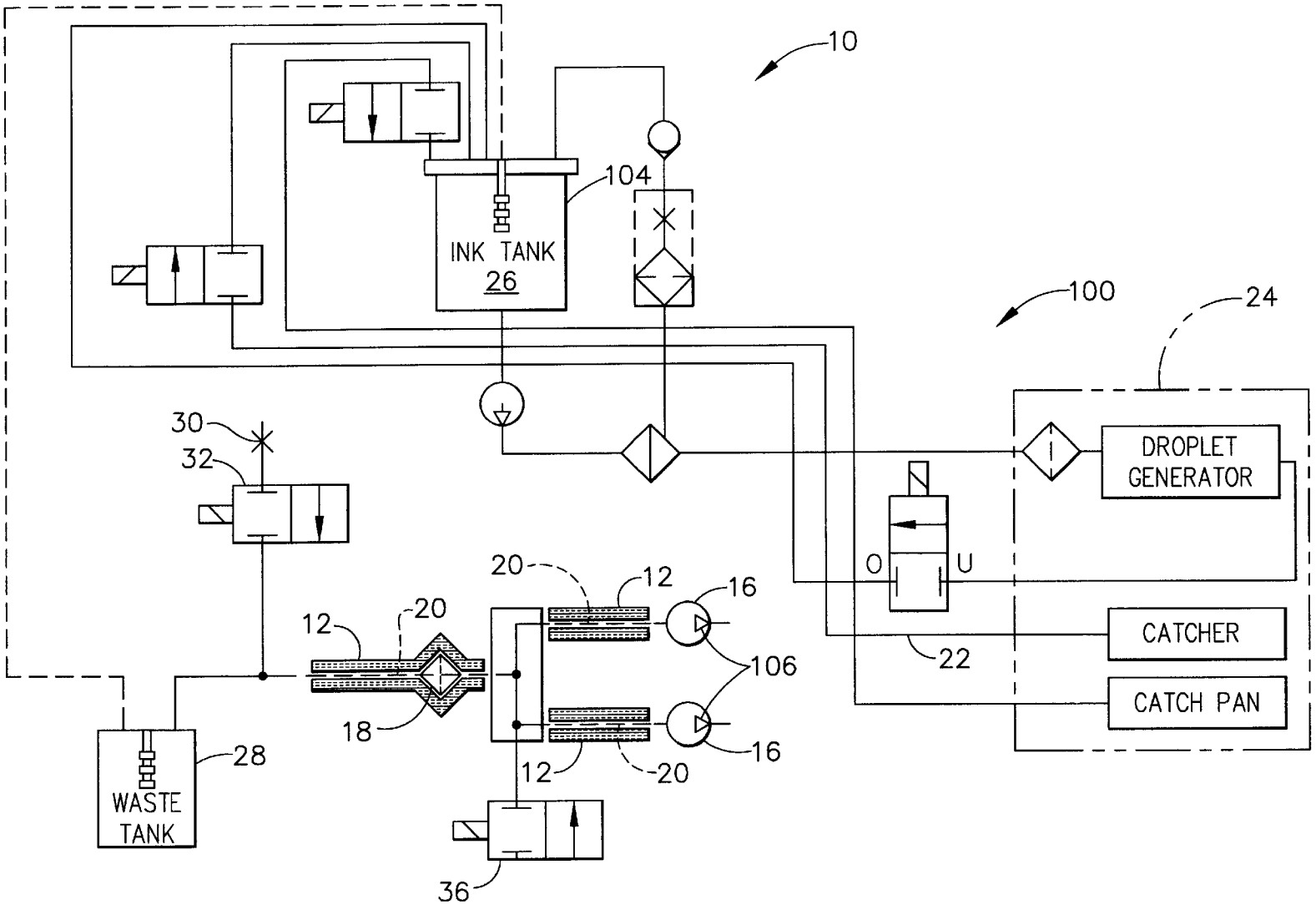
DROPLET GENERATOR
CATCHER
CATCH PAN
24
100
10
22
U
O
106
16
16
12
20
20
12
36
104
INK TANK
26
20
18
12
30
32
28
WASTE TANK

VACUUM SYSTEM FOR CONTINUOUS INK JET PRINTERS

TECHNICAL FIELD

The present invention relates to the field of continuous ink jet printing and, more particularly, to improved vacuum means for use in continuous ink jet printers.

BACKGROUND ART

In continuous ink jet printing systems, ink from an ink reservoir is supplied under pressure to a manifold that distributes the ink to a plurality of orifices, typically arranged in linear array(s). The ink is expelled from the orifices in jets which break up into droplet streams, due to surface tension in the ink. Ink jet printing is accomplished with these droplet streams by selectively charging and deflecting some droplets from their normal trajectories. The appropriate deflected or undeflected droplets are allowed to impinge on a printing surface, and the others, not need to form the printed image, are captured by catcher means so that the fluid can be re-circulated. To retrieve the ink from the catcher means, the ink reservoir is typically under vacuum supplied by a vacuum pump.

In a typical ink jet printer, the vacuum capacity requirements (flow times pressure) are dictated by the crossflush, startup and shutdown conditions. The vacuum requirements for these conditions can require on the order of five times as high as for the normal operating condition. It is therefore necessary to control the vacuum levels in some manner.

Prior art long array ink jet printers have used single speed AC vacuum pumps to provide the required vacuum. Control of the vacuum levels has been provided by means of either air bleed means or by means to throttle the flow to the vacuum pump. These control means may include mechanical regulator valves or servo controlled flow control means, as in U.S. Pat. No. 5,394,177. With such vacuum systems the vacuum pump is operated at near rated capacity. This leads to higher than ideal wear on the pump. It also contributes significantly to the fluid system noise and cooling load. As AC pumps are typically used, one must also size the vacuum system to deal with the range of lines voltages present in the various countries. It has also been found that the controlling means, the regulator valves and the servo controlled throttle valve are prone to fail as a result of small amounts of ink mist which can be sucked out of the ink reservoir. This can result in system failures due to the improper vacuum levels which can then occur.

As discussed in commonly assigned, copending patent application Ser. No. 09/211,204, it is desirable for the ink to be heated to a temperature greater than ambient in the ink jet printing system. This elevated ink temperature improves the print window of the printhead. During operation, the catcher draws in air from the environment along with ink to be re-circulated. This air comes in at normal ambient conditions, e.g., 20 C. and 40% Relative Humidity (RH). As the air travels through the umbilical along with the heated ink, it becomes both heated and humidified. At the fluid system, the air enters the ink reservoir at approximately 40 C. and 100% RH. It then travels out from the ink tank, through the waste tank, and finally through the vacuum pumps.

While the ink reservoir is kept hot by the continual recirculation of heated ink, the vacuum lines and the waste tank are not. They are cooled by cooling fans in the fluid system cabinet so they are only slightly warmer than the ambient air. As the moist air passes through the waste tank and vacuum lines, it cools and becomes supersaturated. Water therefore condenses out on the walls of the vacuum lines. The water which forms on the walls of the vacuum lines gets dragged along or entrained by the air flow in the lines. As a result, water is carried into the vacuum pump or pumps. The entrained liquid can cause damage to the vacuum pumps in two ways. First, the liquid can occasionally be pulled into the vane area and cause hydraulic pressures to develop between the vane and the cavity wall, causing the vanes to break. Second, the water can seep into the cavity area during "off" periods. This can rust the rotor, cover plate and cavity. The rotor is then "welded" to the surrounding parts, so that it cannot turn.

It is seen, then, that there exists a need for an improved vacuum system. One that can provide the necessary control of the vacuum levels while reducing the wear on the vacuum pump and reducing the risk of failure of the vacuum controlling means. The improved vacuum system should also protect the vacuum pumps against failure produced by condensed water in the vacuum lines.

SUMMARY OF THE INVENTION

This need is met by the present invention wherein a means is provided for preventing condensation of water in a vacuum pump used on continuous ink jet printers.

In accordance with one aspect of the present invention, a system and method are provided for protecting the vacuum pump of an ink jet printer system from the harmful effects of condensation in the vacuum lines, and from the harmful effects of moisture and water in the vacuum lines. This is accomplished by suppressing the condensation and drying the vacuum line walls.

Other objects and advantages of the invention will be apparent from the following description, the accompanying drawing and the appended claims.

BRIEF DESCRIPTION OF THE DRAWINGS

FIG. 1 is a schematic block diagram of the improved vacuum system in accordance with the present invention.

DETAILED DESCRIPTION OF THE PREFERRED EMBODIMENT

In the present invention, the ink tank is under vacuum supplied by at least one variable speed, brushless VDC vacuum pumps 106. By having the pumps 106 powered by DC voltage, the pumps are servo-controlled thereby allowing tight control of vacuum levels within the ink tank 104 and the system 100, eliminating a vacuum flow control device in the existing fluid system 10 along with their failure mode. The brushless motors are chosen for their reliability.

In a preferred embodiment two vacuum pumps in parallel supply the vacuum as shown in FIG. 1. Two pumps were required to provide the necessary vacuum capacity. In the system 100, one pump 106 could act as the main vacuum pump while the other pump 106 acts as a "booster" pump to help supply higher flow rates for shutdown and startup procedures. The designated main pump duties can also be switched between the two pumps 106 to help increase the life of the pumps. Alternatively, the pumps 106 can be driven in parallel, with comparable flow rates. As the vacuum pumps, during normal operating condition, are operated below capacity, and tend to run quite cool. This is good for the life of the motors and the vanes. This also helps to reduce the noise produced by the vacuum system and it reduces the heat build up in the fluid system.

The cooler operation of the vacuum pumps, however, makes them more susceptible to failure due to condensed water being entrained into the vacuum pumps. In the prior art, the high temperature of the vacuum pumps tended to cause any entrained water to flash into steam when it touched any of the working surfaces of the pump. Since the vacuum pumps of the present invention are running cool, any entrained water which is carried into the vacuum pump, will not "flash" into steam as it hits the working surfaces of the pump.

The need to protect the vacuum pump in an ink jet printer from corrosion produced by condensed water in the vacuum lines has been met by another aspect of the present invention, which suppresses or eliminates the condensation of water in the vacuum lines. With the condensation suppressed or eliminated, water on the wall of the vacuum lines is not entrained into the vacuum pump. This has the further advantage of eliminating the build-up of water in the vacuum pump and the formation of rust in the vacuum pump.

When ink is heated to a temperature greater than ambient, the elevated ink temperature improves the operation of printhead 24. Air is drawn into the ink reservoir along with the returning ink through the catcher return line 22. The air enters ink reservoir 26 at a temperature slightly cooler than the heated ink temperature, and at a relative humidity (RH) of 100% RH. It then travels out from the ink tank 26, through waste tank 28, and finally through the vacuum pump 16. As the air passes through the vacuum lines, some of the moisture can condense on the cool walls of the vacuum lines.

In a preferred embodiment of the present invention, condensation of water in the vacuum lines is suppressed by raising the wall temperature of the vacuum lines 20. As the temperature of the vacuum line walls rises, the amount of condensation drops. If the wall temperature exceeds the dew point for the air in the vacuum lines, condensation would cease. Any suitable means can be employed for raising the wall temperature.

In a particular preferred embodiment, the heat required to raise the wall temperature of the vacuum lines is provided by the warm air being drawn through the vacuum lines. Normally the exterior of the vacuum lines are cooled by the air circulated by cooling fans in the fluid system. Insulating the vacuum lines however reduces this heat loss, so that the inside walls of the vacuum lines can be heated by the ink.

Referring now to FIG. 1, there is illustrated a schematic block diagram 10 of the vacuum pump protection technique according to the present invention. The insulation 12 is placed around mist filter 18 and line 20 into the vacuum pump 16. This keeps the inside surfaces warm, thus preventing condensation. While any insulation 12 could be employed, a preferred embodiment utilizes Armaflex insulation from Armstrong Rubber. This material was chosen as it meets the desired UL standards for flammability.

In a preferred embodiment, the condensation of water in the vacuum lines is also suppressed by lowering the relative humidity of the air in the lines. One preferred means to do this is to bleed a small amount of lower relative humidity air into the vacuum lines. A small amount of ambient air may be bled into the vacuum lines through orifice 30 and bleed solenoid valve 32, as shown in FIG. 1. During normal operation, the solenoid valve 32 is open, allowing a small amount of air to enter. The flow is restricted sufficiently by the orifice 30, having an approximate diameter of 0.030" in a preferred embodiment, to still allow the vacuum pumps to operate significantly below capacity. This helps to maintain the high reliability of the pumps. During the times of high demand for the vacuum system, e.g., startup and shutdown, the valve 32 is closed. Otherwise, it remains open.

As an additional step to protect the vacuum pump 16 from the risk of corrosion produced by moisture in the vacuum lines, a drying step may be included in the shutdown sequence of the printer. The drying step removes any residual moisture left in the pump prior to shutdown, to prevent possible corrosion. The pump drying step involves drawing heating up the vacuum pumps and drawing a large amount of low relative humidity air through them. This is accomplished by opening not only the air bleed valve 32 but also the vacuum pump purge valve 36. With at lack of a restrictor associated with the vacuum pump purge valve, large amounts of air can be drawn in. By operating the vacuum pumps at near rated power levels, the vacuum pumps can be heated up. To this end, it increases the flow rate of drying air through the vacuum system and it raises the temperature of the pump. The heating of the pump is done by operating near rated pump capacity.

The drying step takes place on shutdown after all the rest of the shutdown sequence has been completed. A vacuum pump purge valve 36 is opened along with the bleed valve 32. This allows a large amount of air to be drawn through the vacuum lines and the vacuum pump. With the valves open and the servo-control of the vacuum pumps set to maintain a high vacuum level, the pumps are made to run near capacity. This heats up the vacuum pumps to dry out any residual moisture. A minute of operating near capacity running, followed by a few minutes at reduced speed has proved effective.

During operation of an ink jet printer, it is common for a small amount of foam to be produced by the ink returning to the ink reservoir. As the foam bubbles burst, a fine spray of ink drops can be formed. Some of this spray and be drawn into the vacuum line. To protect the vacuum pump from this ink mist, a mist filter 34 can be inserted into the vacuum line.

In accordance with the present invention, improved vacuum system reliability is provided by using at least one dc servo driven vacuum pump. Preferably two pumps are used in parallel. Unwanted condensation is prevented from collecting in a vacuum pump by bringing low humidity air in through a "bleed orifice", and by insulation being applied to the fluid lines near the vacuum pump to keep them relatively warm.

The description herein has discussed condensation and relative humidity for purposes of description only and is not to be considered as limiting the invention to any particular fluid. For example, the concept of the present invention is as applicable to non-water based inks as it is to water as the fluid. Furthermore, the discussions of relative humidity are not to be considered as limiting the invention to water, as the concept of the invention is equally applicable to other fluid vapors.

The invention has been described in detail with particular reference to certain preferred embodiments thereof, but it will be understood that modifications and variations can be effected within the spirit and scope of the invention.

What is claimed is:

1. A system for protecting an ink jet printer system from harmful effects of condensation, comprising:

providing a vacuum pump for the ink jet printer system, the vacuum pump having associated vacuum lines; and suppression means for suppressing condensation in the vacuum lines.

2. A system as claimed in claim 1 wherein the suppression means comprise means for lowering a relative humidity of air in the vacuum lines.

3. A system as claimed in claim 2 wherein the means for lowering the relative humidity comprises low relative humidity air mixed in with existing high relative humidity air in the vacuum lines.

4. A system as claimed in claim 3 further comprising an air bleed to bring extra ambient air into the vacuum lines.

5. A system as claimed in claim 4 wherein the suppression means comprise means for raising a temperature of the vacuum line walls.

6. A system as claimed in claim 4 further comprising a restricting orifice for the air bleed.

7. A system as claimed in claim 4 wherein the air bleed is selectable.

8. A system as claimed in claim 2 wherein the means for lowering comprise an increased air temperature.

9. A system as claimed in claim 1 wherein the vacuum pump comprises a servo driven pump.

10. A system as claimed in claim 1 further comprising means for drying the vacuum pump.

11. A system as claimed in claim 1 wherein the vacuum pump is operated at near capacity.

* * * * *